US008863675B2

(12) United States Patent
Günther et al.

(10) Patent No.: US 8,863,675 B2
(45) Date of Patent: Oct. 21, 2014

(54) STEAM GENERATOR FOR PRODUCING SUPERHEATED STEAM IN A WASTE INCINERATION PLANT

(75) Inventors: Johannes Günther, Limburgerhof (DE); Hansjörg Roll, Wörth Am Rhein (DE); Peter Knapp, Limburgerhof (DE); Uwe Zickert, Schifferstadt (DE)

(73) Assignee: MVV Umwelt GmbH, Mannheim (DE)

( * ) Notice: Subject to any disclaimer, the term of this patent is extended or adjusted under 35 U.S.C. 154(b) by 1214 days.

(21) Appl. No.: 12/632,014

(22) Filed: Dec. 7, 2009

(65) Prior Publication Data

US 2010/0139535 A1 Jun. 10, 2010

(30) Foreign Application Priority Data

Dec. 6, 2008 (DE) ..... 10 2008 060 918

(51) Int. Cl.

| | |
|---|---|
| ***F23M 9/00*** | (2006.01) |
| ***F22B 37/10*** | (2006.01) |
| ***F22G 1/06*** | (2006.01) |
| ***F22G 7/14*** | (2006.01) |
| ***F22G 1/02*** | (2006.01) |

(52) U.S. Cl.

CPC ..... *F22B 37/108* (2013.01); *F22G 1/06* (2013.01); *F22G 7/14* (2013.01); *F22G 1/02* (2013.01)

USPC ..... 110/322; 110/234; 122/135.1; 122/468

(58) Field of Classification Search

CPC . F23M 5/02; F23M 2900/05004; F23M 9/06; F23M 9/00; F24H 9/0052; F24H 9/0005; F24H 9/0026; F23G 5/46; F22B 17/10; F22B 37/10; F22B 37/40; F22B 37/108; F22G 1/02; F22G 1/06; F22G 7/00; F22G 7/14

USPC ..... 110/322, 234, 343, 346, 245; 122/471, 122/135.1, 6, 6 R, 137, 468; 432/148, 155, 432/170, 188, 209

See application file for complete search history.

(56) References Cited

U.S. PATENT DOCUMENTS 1,720,323 A * 7/1929 Freiday ..... 285/300
2,654,352 A * 10/1953 Schoenfeld ..... 122/494

(Continued)

FOREIGN PATENT DOCUMENTS

BE 641471 A 4/1964
DE 1200834 B 9/1965

(Continued)

OTHER PUBLICATIONS

E-On Journal/ Customer Magazine, Edition 2, Sep. 2003; Gelsenkirchen, Germany; 2003.

*Primary Examiner* — Kenneth Rinehart
*Assistant Examiner* — Bao D Nguyen
(74) *Attorney, Agent, or Firm* — Laurence A. Greenberg; Werner H. Stemer; Ralph E. Locher

(57) ABSTRACT

A steam generator for producing superheated steam in a waste incineration plant, includes a boiler housing having a combustion chamber with walls having an evaporator. The evaporator has tubes carrying water and being acted upon by heat energy released during incineration of waste, for producing superheated steam. A wall superheater for increasing temperature of the superheated steam includes a plurality of tubes in a wall of the boiler housing for carrying superheated steam being protected against flue gas from an incineration process by plate-like elements formed of a corrosion-proof material. The boiler housing includes an evaporator housing section having the water-carrying tubes and a wall-superheater housing section spatially separated from the evaporator housing section and having the superheated steam-carrying tubes. The wall-superheater housing section is movable relative to and disposed downstream of the evaporator housing section in flue gas flow direction.

7 Claims, 2 Drawing Sheets

(56) References Cited

U.S. PATENT DOCUMENTS

| | | | | |
|---|---|---|---|---|
| 3,208,436 | A | 9/1965 | Godshalk | |
| 3,298,360 | A * | 1/1967 | Michel | 122/510 |
| 4,023,782 | A | 5/1977 | Eifer | |
| 4,106,286 | A * | 8/1978 | Sakai et al. | 60/39.182 |
| 4,418,652 | A * | 12/1983 | Rees | 122/468 |
| 4,641,608 | A | 2/1987 | Waryasz | |
| 5,366,255 | A | 11/1994 | Garkawe | |
| 6,269,754 | B1 * | 8/2001 | Ruegg et al. | 110/234 |
| 2008/0302314 | A1 * | 12/2008 | Gonzalez et al. | 122/1 R |

FOREIGN PATENT DOCUMENTS

| | | | | |
|---|---|---|---|---|
| DE | 1401371 | A1 | 12/1968 | |
| DE | 19749715 | A1 | 5/1999 | |
| DE | 10257305 | A1 | 6/2004 | |
| DE | 60107618 | T2 | 12/2005 | |
| EP | 0559387 | A1 | 9/1993 | |
| EP | 0981015 | A1 | 2/2000 | |
| EP | 0 981 015 | B1 | 5/2004 | |
| GB | 870735 | A | 6/1961 | |
| WO | WO 2007036913 | A2 * | 4/2007 | F22B 31/045 |

* cited by examiner

STEAM GENERATOR FOR PRODUCING SUPERHEATED STEAM IN A WASTE INCINERATION PLANT

CROSS-REFERENCE TO RELATED APPLICATION

This application claims the priority, under 35 U.S.C. §119, of German Patent Application DE 10 2008 060 918.8, filed Dec. 6, 2008; the prior application is herewith incorporated by reference in its entirety.

BACKGROUND OF THE INVENTION

Field of the Invention

The invention relates to a steam generator for producing superheated steam in a waste incineration plant, including a boiler housing having a combustion chamber with walls having an evaporator with tubes exposed to a throughflow of water and acted upon by heat energy released during the incineration of the waste for producing superheated steam, and a wall superheater for increasing the temperature of the superheated steam including a plurality of tubes exposed to a throughflow by the superheated steam and protected against flue gas resulting during the incineration process by plate-like elements formed of a corrosion-proof material.

Waste incineration plants are associated with the prior art and are widely used in Western Europe, in particular. In most plants, the waste is incinerated through the use of grate firing. The energy which is released during the incineration is customarily used in that case for producing high-pressure steam which is used in a steam turbine for power generation. Furthermore, plants are known in which in addition to power generation some of the energy is converted into process steam or district heating. The boundary conditions for such a type of heat utilization, however, are possible only at a limited number of sites.

In the case of plants which are used in Central Europe, boilers are preferably used as steam generators, in which the flue gas, that is formed as a result of the incineration process, after leaving the combustion chamber flows through a second flue, with downwards flow, into a third flue, with upwards flow, and then flows into a horizontal flue bundle, wherein the latter is frequently also referred to as a convection section.

Plants are also known, however, in which the gases, after leaving the combustion chamber, flow directly into the horizontal convection flue. The previously-described boilers with horizontally-extending convection sections are also referred to in professional circles as horizontal flue boilers.

In the case of the previously-described waste incineration plants, the convection section includes an evaporator, a finishing superheater, a superheater and a first economizer, which are accommodated in the previously referred to sequence in the convection section and are exposed to throughflow by the flue gas in order to extract heat energy therefrom through the resulting convection.

That configuration of heating surfaces in the convection section, on which the thermal energy of the flue gas is predominantly transmitted through the use of convection, is preferably used at a pressure of the superheated steam of up to about 40 bar and a temperature of the superheated steam of up to about 400° C., which represent the customary steam parameters of today.

The efficiency of the plants, as is known, is influenced to a high degree by the temperature and the pressure of the live steam, wherein a high steam temperature leads to high efficiency which, in the case of the existing plants, lies in the region of about 25% with regard to the electrically producible energy.

Although it is desirable to increase the steam temperature to a value of more than 400° C. for increasing the efficiency of the waste incineration plants, in most cases that is not realized in known waste incineration plants for reasons of corrosion, since steam temperatures >400° C. and tube outside wall temperatures of >430-450° C., which are associated therewith, on the finishing superheaters in the convection section of the plants which are used for increasing the efficiency, disadvantageously lead to an increased occurrence of corrosions. Those corrosions are induced by the aggressive pollutants which are carried along by the flue gas being deposited on the hot tubes of the heat exchangers of the finishing superheaters as incrustations which, in conjunction with the high temperatures, after a short time lead to a corrosion-induced destruction of the components.

In order to protect the walls of the waste incineration plant combustion chamber, which is disposed flow-wise upstream of the convection section, against corrosion as a result of the flue gases which result during the incineration process, plates or refractories with a high thermal conductivity, which for example are formed of silicon carbide or ceramic, are frequently attached on the walls of the combustion chamber. Those plates are sometimes also attached at a certain distance from the tube wall so that between the inner side of the plates and the outer side of the tube wall a gap is created which is preferably pressurized with a non-corrosive gaseous atmosphere, for example with air. As a result of that measure, the corrosive flue gases, which can diffuse through cracks or pores in the plates or in the refractory, do not lead to damage of the water-carrying high-pressure lines in the walls of the combustion chamber.

A waste incineration plant with a steam generator, in which a wall superheater in the form of a finishing superheater is used, which together with the evaporator is disposed in the lower section of the combustion chamber of the boiler, in which the heat transfer is primarily carried out through the use of the heat radiation which results during the incineration process, is known from European Patent EP 0 981 015 B1, corresponding to U.S. Pat. No. 6,269,754. In order to prevent corrosion of the horizontally extending superheater tubes of the finishing superheater and also of the outer wall of the combustion chamber, the superheater tubes towards the inner side of the combustion chamber are covered by plates formed of ceramic material which are disposed at a distance from the tubes. The gap which is created in the process between the inner side of the combustion chamber wall and the plates in that case is filled with a gas which has a slightly higher pressure than the pressure of the combustion gases in the combustion chamber in order to prevent ingress of the combustion gases into the gap.

As a result of the tubes of the finishing superheater and of the evaporator being disposed directly next to each other, the problem arises in the case of the described steam generator of the steam-carrying superheater tubes being cooled again by the evaporator tubes which in contrast carry considerably cooler water, as a result of which the necessary heat exchange surface is increased and the achievable steam temperature in the superheater is limited.

SUMMARY OF THE INVENTION

It is accordingly an object of the invention to provide a steam generator for producing superheated steam in a waste incineration plant, which overcomes the hereinafore-mentioned disadvantages of the heretofore-known devices of this general type and with which efficiency when producing superheated steam can be further increased without the service life of components which carry the superheated live steam being disadvantageously impaired for corrosion-related reasons.

With the foregoing and other objects in view there is provided, in accordance with the invention, a steam generator for producing superheated steam in a waste incineration plant. The steam generator includes a boiler which has a combustion chamber, the walls of which boiler have an evaporator with tubes which are exposed to throughflow by water and acted upon by heat energy for producing superheated steam, wherein the heat energy is generated during the incineration of waste in the combustion chamber. The steam generator according to the invention furthermore has a wall superheater which is preferably constructed as a finishing superheater that includes a plurality of tubes which are accommodated in the wall of the boiler housing and are exposed to throughflow by the superheated steam, which is produced in the evaporator and preferably in a presuperheater which is disposed in the convection section, in order to increase the temperature of the superheated steam to more than 470° C., with a pressure of at least 60 bar. In order to protect the superheated steam-carrying tubes of the wall superheater against the flue gas which results during the incineration process, the tubes are protected through the use of a fireproof lining, especially in the form of ventilated, plate-like elements formed of a corrosion-proof material, for example of silicon carbide or another ceramic material, wherein a gap between tube wall and fireproof lining is filled or pressurized with a non-corrosive gas.

The steam generator according to the invention is distinguished in that the boiler housing includes an evaporator housing section which includes the evaporator, and also a wall-superheater housing section which includes the wall superheater and is spatially separated from the evaporator housing section, wherein the wall-superheater housing section is disposed downstream of the evaporator housing section as seen in the flow direction of the flue gas, and the two housing sections are constructed separately and movable relative to each other in order to enable a thermally induced, varied expansion of the materials. One or more further evaporator housing sections, which are exposed to throughflow by the flue gas, can be disposed downstream of the wall-superheater housing section for improving the overall efficiency of the plant.

As a result of the construction of the steam generator according to the invention, the advantage arises of significantly higher superheater temperatures being able to be operated in waste incineration plants as compared with conventional steam generators, without a corrosion-induced destruction of the tubes of the superheater that previously occurred after a short time. In the case of a construction of the wall superheater as a finishing superheater, which finally heats the superheated steam before it is fed to a turbine of the waste incineration plant for driving an electric generator, the temperatures can lie at up to 550° C., wherein the steam pressure can be up to 150 bar.

In accordance with a first embodiment of the invention, the boiler housing includes a first vertical flue which includes the combustion chamber and a second flue for the flue gas which is connected flow-wise to the first vertical flue, wherein the flue gas flows in the upwards direction in the first flue and in the downwards direction in the second flue. The wall-superheater housing section in this case has the form of an outwardly closed hood or a cap which is fitted onto the first flue and onto the second flue, and closes them off at the top in a gas-tight manner so that the flue gas which discharges from the first flue is deflected into the second flue. This embodiment of the invention has the advantage that the base area which is required for the boiler is not increased despite the improved efficiency.

As a result of the spatial separation according to the invention between the comparatively cool evaporator housing section and the wall-superheater housing section, which is considerably hotter as compared therewith, in the form of the hood which is fitted onto the first and second flue, the advantage furthermore arises of the radiation section of the boiler, i.e. especially the combustion chamber wall, being able to be constructed more cost-effectively than the evaporator wall which includes a multiplicity of tubes that are disposed next to each other and preferably extend in the vertical direction. These tubes, which carry the water which is supplied for producing the superheated steam, are preferably interconnected through ribs and form an outwardly closed, encompassing wall which absorbs the thermal energy from the combustion chamber primarily through the resulting heat radiation.

The wall-superheater housing section is preferably supported in the case of this embodiment of the invention on the boiler frame and is connected through compensators in a flue-gastight manner to the evaporator housing section, as a result of which a temperature-induced displacement of the wall-superheater housing section in relation to the evaporator housing section is enabled. As a result of this, particularly when using an evaporator housing section with a tube-rib-tube evaporator wall, the advantage arises of the two housing sections being inexpensively produced and a thermal length expansion of the tubes of the evaporator wall and also of the tubes of the wall superheater in the vertical direction being able to be compensated without costly measures through the use of compensators which are known from the prior art.

In accordance with a second embodiment of the invention, the boiler housing has a first vertical flue which includes the combustion chamber and a further vertical flue for the flue gas which is connected flow-wise to the first vertical flue. The flue gas flows in the upwards direction in the first flue and flows in the downwards direction in the further flue, which is subsequently also referred to as the second flue, and in a known manner is deflected from the first flue into the second flue through the use of a deflection section which in this case does not include any additional tubes. The first flue, in the case of this embodiment of the invention, exclusively includes the evaporator housing section and the second flue exclusively includes the wall-superheater housing section, wherein the first flue and the second flue form independent units which are movable relative to each other in the vertical direction. In order to enable a free movement of the two housing sections in the vertical direction and in the horizontal direction in relation to each other, the outer walls of the housing sections are preferably disposed at a distance from each other.

The last-described embodiment has the advantage that the heat-transferring area of the wall-superheater housing section can be altogether increased as compared with the first-described hood-like embodiment, without increasing the overall height, as a result of which the efficiency of the plant can be increased once more. If necessary, provision can be made for further vertical flues, for example a third and a fourth flue with the live steam-carrying tubes being protected against corrosion through the use of plates formed of ceramic material. At least some of the steam-carrying tubes in this case can also be associated with a reheater which additionally superheats the steam that is produced in the evaporator before it is fed to the finishing superheater in order to once again increase the efficiency as a result thereof.

In the same way, as in the case of the first-described embodiment with a hood-like finishing superheater, the water-carrying tubes of the evaporator housing section are also preferably interconnected through ribs in the case of this embodiment and form an encompassing tube-rib-tube evaporator wall which is outwardly closed off. As a result of this, the advantage arises of the lower section of the boiler being able to be cost-effectively produced according to the proven tube-rib-tube principle.

In accordance with a concomitant feature of the invention, in the case of the previously-described embodiments of the invention, the tubes of the wall-superheater housing section, which are exposed to throughflow by the superheated steam, are preferably accommodated in a gap which is formed between the inner wall of the plates formed of corrosion-proof material and the outer wall of the wall-superheater housing section, with the gap being pressurized with a gas in such a way that an overpressure is created in the gap which prevents ingress of the flue gas into the gap. The gas is preferably air or recirculated clean gas which, for example through a fan, can be blown into the gap between the outer wall of the wall-superheater housing section and the plate-like elements with an overpressure of, for example, 0.005 bar.

Other features which are considered as characteristic for the invention are set forth in the appended claims.

Although the invention is illustrated and described herein as embodied in a steam generator for producing superheated steam in a waste incineration plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
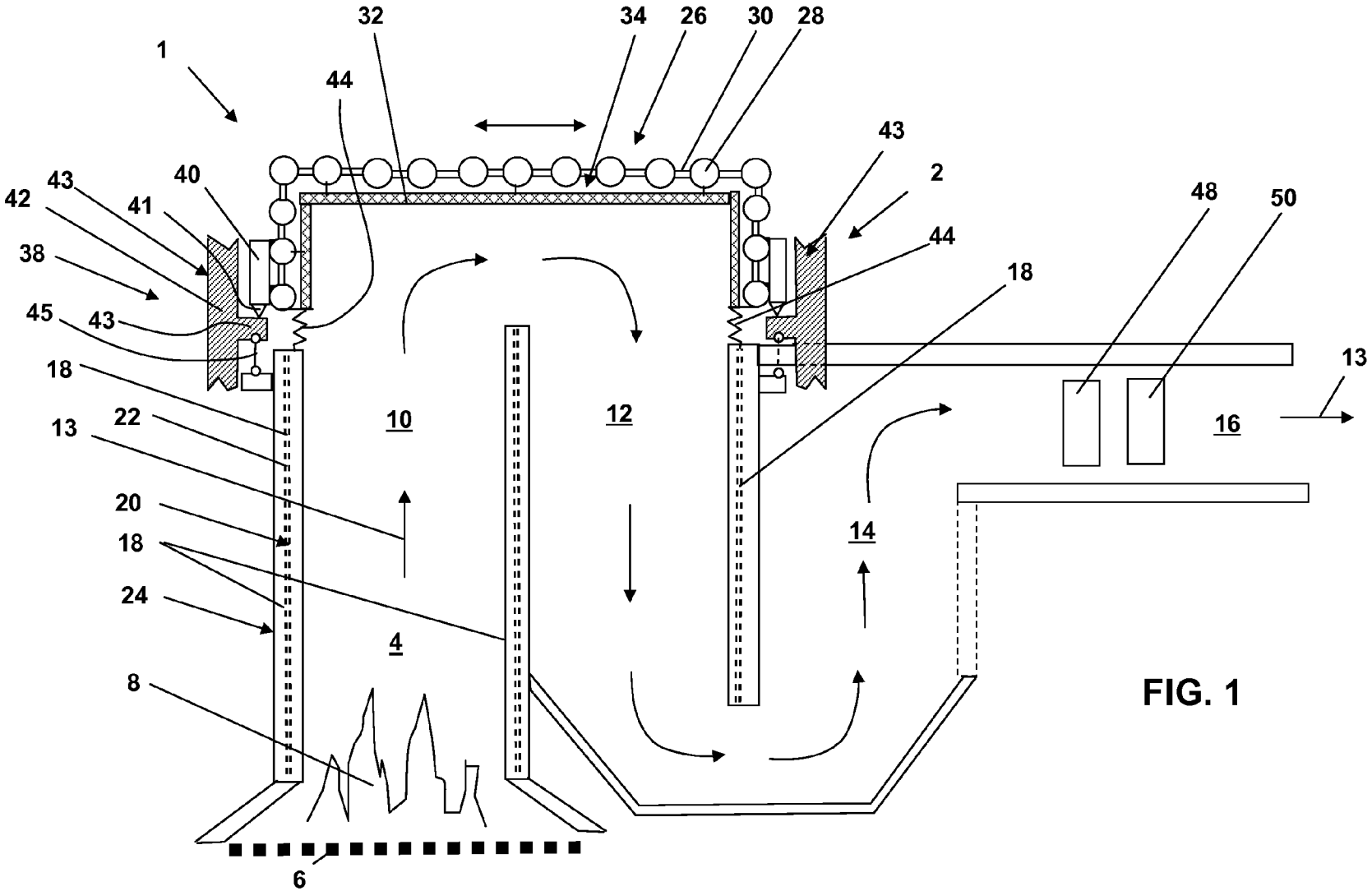
FIG. 1 is a diagrammatic, cross-sectional view of a first embodiment of the invention, in which a wall-superheater housing section is fitted in the manner of a hood onto first and second housing sections constructed as an evaporator wall.

Referring now to the figures of the drawings in detail and first, particularly, to FIG. 1 thereof, there is seen a steam generator 1, which is disposed in a waste incineration plant that is not fully shown for technical presentation reasons. The steam generator 1 includes a boiler housing 2 in which a combustion chamber 4 is formed. Waste, which is not shown in more detail, is incinerated in the combustion chamber 4, for example on a grate 6, creating a flame 8.

Highly corrosive flue gas 13, which results during the incineration process, flows in this case along the arrows in an upward direction in a first flue 10, which is also referred as a radiation section since released thermal energy is primarily transferred therein as a result of heat radiation.

The flue gas 13 is deflected in an upper region of the first flue 10 into a second flue 12 which extends parallel to the first flue 10 and in which the flue gas 13 flows in the downward direction. The flue gas 13 subsequently flows from the second flue 12 in the upwards direction again through a subsequent third flue 14 and from there enters a horizontally extending fourth flue 16, from where it is then directed to a cleaning device of the waste incineration plant, which is not shown in more detail. The fourth flue is subsequently referred to as a convection section.

In the case of the embodiment of the invention which is shown in FIG. 1, the walls of the combustion chamber 4 are constructed as an evaporator wall 18 which includes a multiplicity of tubes 20 that are disposed parallel to each other, extend in the vertical direction, are interconnected through ribs 22 shown in broken lines, and form an encompassing, closed, gastight wall in which water that is guided in the tubes 20 is heated for producing superheated steam through the use of the heat radiation which is released during the incineration.

As can be furthermore gathered from the view of FIG. 1, the evaporator wall 18, which is produced according to the tube-rib-tube principle, with the evaporator tubes 20 which are included therein, forms an independent evaporator housing section 24. Due to the water which is guided through the tubes 20 during operation of the steam generator 1, the walls of the evaporator housing section 24 assume a temperature in the region of about 300° C., depending upon steam pressure.

As can be furthermore gathered in this case from the view of FIG. 1, the evaporator housing section 24 is closed off towards the top through the use of a wall-superheater housing section 26 which includes a multiplicity of tubes 28 that are preferably also interconnected through ribs 30. The superheated steam, which is produced in a presuperheater 48 that is preferably located in the horizontally extending fourth flue, is directed into these tubes 28 in order to superheat them further before the steam is fed to a turbine, which is not shown in more detail. The tubes 28 in this case preferably extend in the horizontal direction, as is shown in FIG. 1.

As can be furthermore gathered from the view of FIG. 1, the wall-superheater housing section 26 has the form or shape of an outwardly closed hood which fits over the first flue 10 and the second flue 12 and deflects the flue gas 13, after its exit from the first flue 10, into the second flue 12. In order to avoid corrosion of the tubes 28 in the wall-superheater housing section 26 in this case, which would be destroyed in an exceedingly short time due to the high temperature of the superheated steam of up to 550° C. in the case of a direct contact with the flue gas 13, the inner side of the wall-superheater housing section 26 is provided with a fireproof lining which preferably includes plate-like elements 32 that are produced from a material which is corrosion-proof to the highest degree, for example formed of silicon carbide or another ceramic.

In order to additionally protect the tubes 28 against coming into contact with the flue gas 13 which penetrates through cracks or splits between the plate-like elements 32, provision is made for a gap 34 between the tubes 28 and the inner side of the plate-like elements 32. The gap 34 is pressurized with a gas, for example through a blower which is not shown in more detail, in order to create a pressure inside the gap 34 which, for example, is 0.005 bar higher than the pressure of incineration gases inside the combustion chamber 4. The gas is preferably air or another inert gas and, for example, can also be recirculated, cleaned flue gas.

In order to compensate for thermal length expansions of the material which occur between the comparatively cool evaporator housing section 24 and the hood-like, considerably hotter wall-superheater housing section 26 in this case, the wall-superheater housing section 26 is supported on the evaporator housing section 24 through a slide point 38. The slide point 38, for example, includes a plurality of projections 40 which are fastened on the outer side of the wall-superheater housing section 26 and are supported in each case through a diagrammatically represented support 41 on a projection 43 of a boiler frame 42, which is only partially shown. The projection 43 in this case preferably also supports the evaporator housing section 24 which, through corresponding joints that are not shown in more detail, and for example rod-like connecting elements 45, is suspended on the underside of the respective projection 43. For the purpose of sealing and compensating thermally induced expansions between the wall-superheater housing section 26 and the evaporator housing section 24, these two housing sections are coupled to each other through known compensators 44 which allow a relative movement of the two housing sections 24, 26 in the horizontal as well as in the vertical directions.

Figure 2:
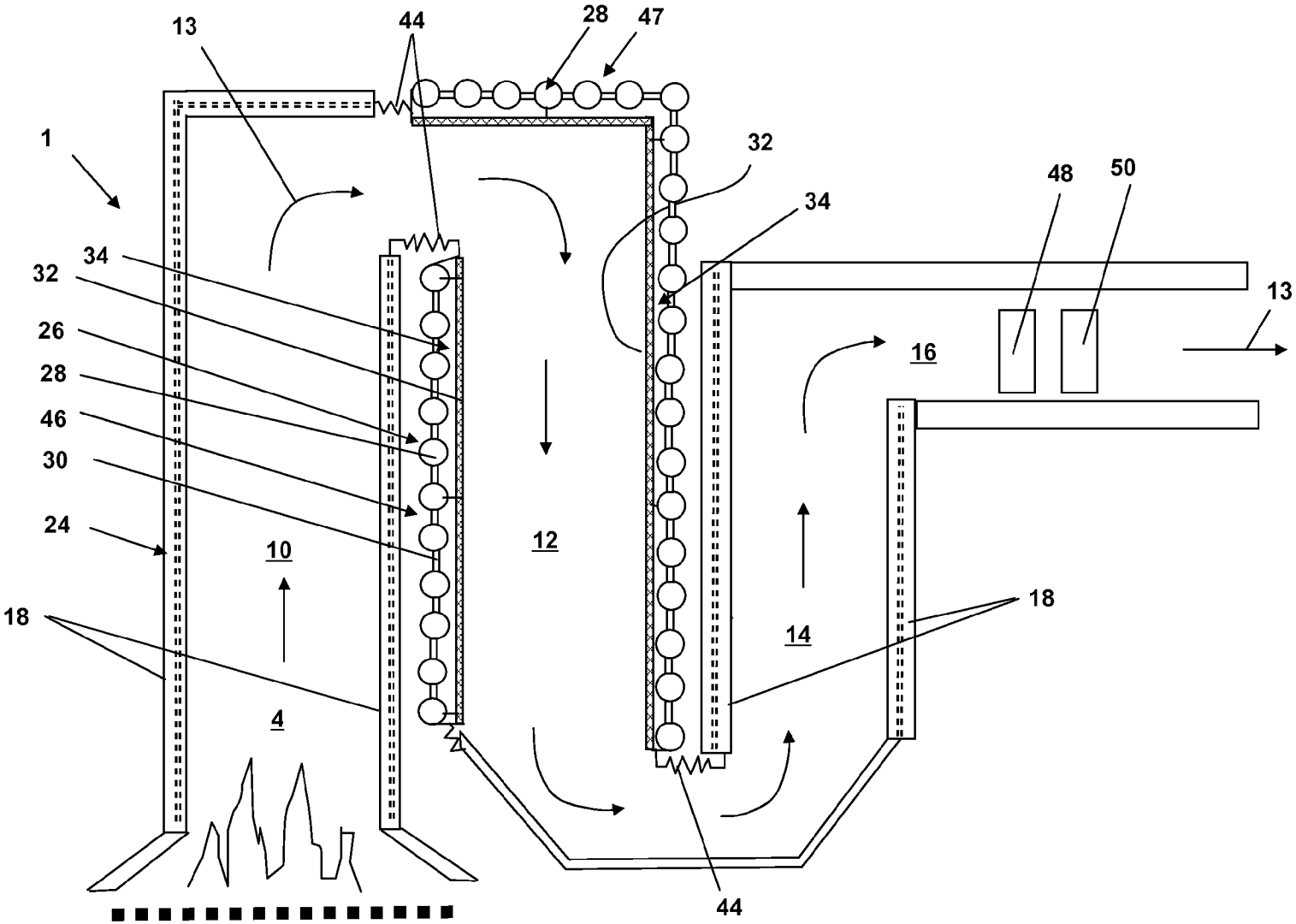
FIG. 2 is a cross-sectional view of a second embodiment of the invention, in which a first flue is constructed completely as an evaporator housing section and a second flue, which is connected thereto, is constructed as a wall-superheater housing section.

In the case of the further embodiment of the invention which is shown in FIG. 2, the evaporator housing section 24, with the evaporator wall 18 which includes the water-carrying tubes 20, and the wall-superheater housing section 26, with the superheated steam-carrying tubes 28, are disposed in such a manner that they lie next to each other. Therefore, the evaporator housing section 24 forms the first flue 10 and the wall-superheater housing section 26 forms the second flue 12 of the boiler housing 2.

In the case of this embodiment of the invention, the evaporator housing section 24 with the encompassing, outwardly closed evaporator wall 18, as well as the wall-superheater housing section 26, are constructed as self-contained units which, according to the view of FIG. 2, are disposed at a distance of, for example, 0.5 m from each other, so that a relative movement of the two housing sections 24, 26 both in the vertical direction and in the horizontal direction is enabled. The self-contained units in this case are coupled to each other in the upper region above the first flue 10 through the use of a deflection element 46. The deflection element 46 is connected to the evaporator housing section 24 as well as to a horizontally extending section 47 of the wall-superheater housing section 26, which is preferably introduced in the case of this embodiment, through compensators 44. The two housing sections 24, 26, as well as the deflection element 46, are supported in the same or similar manner as in the embodiment of FIG. 1 through slide points on a boiler frame, which is not shown in FIG. 2, so that the components are sealed at respective abutment points against an escape of the flue gas 13 through compensators 44.

Additionally, in the case of this embodiment of the invention, the wall-superheater housing section 26 is preferably constructed as a finishing superheater which, in the same manner as in the embodiment of FIG. 1, is lined completely with ventilated, plate-like elements 32 formed of corrosion-proof material, for example of silicon carbide, in order to prevent corrosion of the tubes 28.

In the two previously described embodiments of the invention, further heat exchangers can additionally be disposed in the horizontally extending fourth flue which, for example, includes the presuperheater 48 that additionally superheats the superheated steam which is produced in the evaporator housing section 24, before being fed to the wall-superheater housing section 26 in a further stage, as well as an economizer 50 which is known from the prior art, in order to extract further heat energy which, in this section of the steam generator 1, is primarily convectively transferred, from the flue gas 13 for increasing efficiency.

The invention claimed is:

1. A steam generator for producing superheated steam in a waste incineration plant, the steam generator comprising:

a boiler housing having an evaporator housing section and a wall-superheater housing section, said boiler housing including a first vertical flue and a second flue for flue gas, said second flue connected flow-wise to said first vertical flue, for conducting a flow of the flue gas in an upwards direction in said first flue and in a downwards direction in said second flue;

said wall-superheater housing section being spatially separated from said evaporator housing section, movable relative to said evaporator housing section and disposed downstream of said evaporator housing section in a flow direction of flue gas from an incineration process, said wall-superheater housing section having a shape of an outwardly closed hood upwardly gas-tightly closing off said first flue and said second flue and deflecting the flue gas discharging from said first flue into said second flue;

a combustion chamber disposed in said first flue of said boiler housing and having walls with an evaporator, said evaporator having tubes exposed to a throughflow of water and acted upon by heat energy released during incineration of waste for producing superheated steam, said tubes exposed to a throughflow of water being disposed in said evaporator housing section; and a wall superheater for increasing temperature of the superheated steam, said wall superheater including a plurality of tubes exposed to a throughflow of the superheated steam and plate-shaped elements formed of a corrosion-proof material for protecting said tubes exposed to a throughflow of the superheated steam against the flue gas, said tubes exposed to a throughflow of the superheated steam being disposed in said wall-superheater housing section.

2. The steam generator according to claim 1, wherein said wall-superheater housing section is a finishing superheater in which the superheated steam is heated before being fed to a turbine.

3. The steam generator according to claim 1, which further comprises a boiler frame, said wall-superheater housing section having an underside and being supported in vicinity of said underside on said boiler frame, and said evaporator housing section having an upper side and being suspended in vicinity of said upper side on said boiler frame.

4. The steam generator according to claim 1, which further comprises compensators, said evaporator housing section and said wall-superheater housing section being movable relative to each other through said compensators and being coupled to each other in an outwardly gas-tight manner.

5. The steam generator according to claim 1, which further comprises at least one further evaporator housing section and at least one further wall-superheater housing section.

6. The steam generator according to claim 1, which further comprises ribs interconnecting said tubes exposed to a throughflow of water of said evaporator housing section, forming an encompassing, outwardly-closed evaporator wall.

7. The steam generator according to claim 1, wherein said plate-shaped elements formed of corrosion-proof material form an inner wall, and said tubes exposed to a throughflow of the superheated steam of said wall-superheater housing section and said inner wall define a gap therebetween being pressurized with a gas to create an overpressure in said gap for preventing ingress of flue gas into said gap.

* * * * *